United States Patent [19]

Harris et al.

[11] 4,218,831

[45] Aug. 26, 1980

[54] CONTINUOUS ULTRAVIOLET CURING SYSTEM

[75] Inventors: Robert D. Harris, Saltville; Norman G. Haderer, Bristol, both of Va.

[73] Assignee: Westinghouse Electric Corp., Pittsburgh, Pa.

[21] Appl. No.: 964,314

[22] Filed: Nov. 28, 1978

[51] Int. Cl.[3] ..... F26B 23/04; F26B 3/28

[52] U.S. Cl. ..... 34/4; 34/41; 34/89; 250/493; 118/642

[58] Field of Search ..... 250/493, 502, 503; 118/641, 642, 643; 34/4, 41, 89; 324/21, 25; 340/641, 642

[56] References Cited

U.S. PATENT DOCUMENTS

| | | | |
|---|---|---|---|
| 2,355,752 | 8/1944 | Repking | 340/642 |
| 2,445,443 | 7/1948 | Long | 34/77 |
| 3,409,460 | 11/1968 | Mitchell et al. | 34/4 |
| 3,826,014 | 7/1974 | Helding | 34/41 |
| 3,950,650 | 4/1976 | Pray et al. | 250/504 |
| 4,015,340 | 4/1977 | Treleven | 34/4 |
| 4,019,062 | 4/1977 | Rongren | 250/492 |

*Primary Examiner*—Larry I. Schwartz
*Attorney, Agent, or Firm*—R. D. Fuerle

[57] ABSTRACT

A curing system is disclosed for continuously curing a resinous coating on an elongated member such as a wire. The wire passes through a curing chamber which contains a plurality of removable modules alternately positioned on opposite sides of the wire. Each module contains a source of electromagnetic radiation, such as an ultraviolet lamp, and an excess number of modules is provided. Each lamp can be turned on and off individually. If a lamp fails another lamp is turned on and the curing proceeds while the module containing the defective lamp is removed and the defective lamp is replaced.

17 Claims, 2 Drawing Figures

CONTINUOUS ULTRAVIOLET CURING SYSTEM

BACKGROUND OF THE INVENTION

1. Field of the Invention

In conventional ultraviolet curing systems for curing coatings on wire, a failure of an ultraviolet lamp means that the curing operation must be stopped while the defective lamp is being replaced. During this time the resin on the wire may flow resulting in a non-uniform coating. Also, some wire may pass through the wiring system before the defective lamp is detected, necessitating backing up the wire or discarding a portion of it.

2. Description of the Prior Art

U.S. Pat. No. 4,015,340 to Treleven discloses an ultraviolet curing apparatus. Excess modules are not used and the entire apparatus must be opened to service the lamps.

U.S. Pat. No. 3,950,650 to Pray discloses an apparatus for curing and drying inks with ultraviolet light, but modules are not used.

U.S. Pat. No. 4,019,062 to Rongren discloses an apparatus for curing a coating on a wire using ultraviolet light. Removable modules are not used.

SUMMARY OF THE INVENTION

We have invented an apparatus for curing a resinous coating on a wire using ultraviolet light. In our apparatus the ultraviolet lamps are mounted in modules and an excess number of lamps are used. When a lamp begins to fail one of the extra lamps is turned on and the module containing the defective lamp is removed and the lamp replaced. It is therefore not necessary to shut down the curing operation in order to replace a lamp, nor is the resin on the wire exposed to varying amounts of light during replacement of the lamp.

DESCRIPTION OF THE PREFERRED EMBODIMENT

Figure 2:
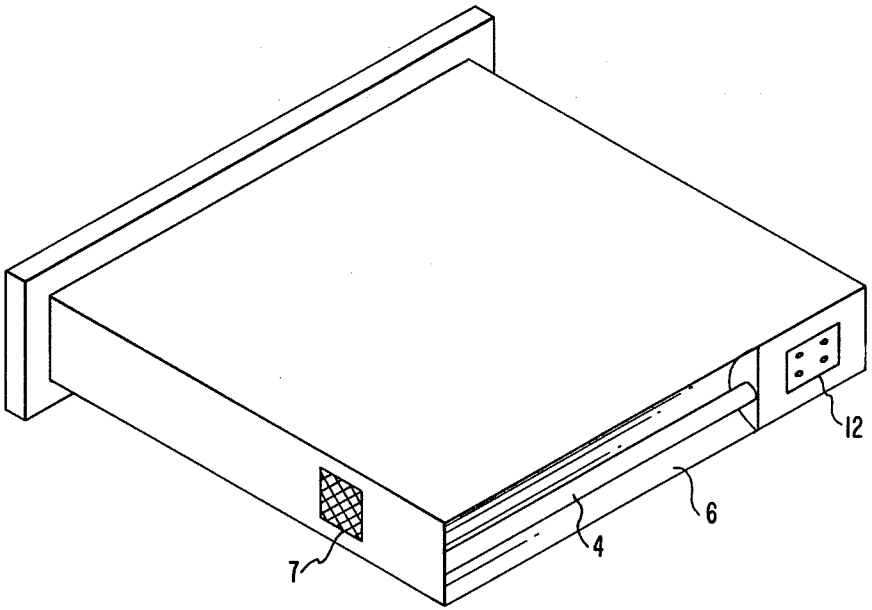
FIG. 2 is an isometric view of one of the modules used in the apparatus shown in FIG. 1.
Figure 1:
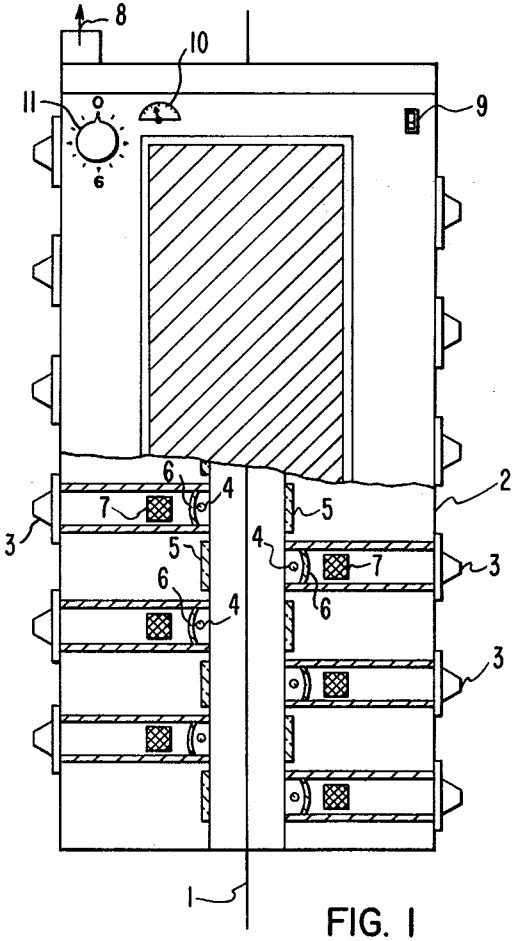
FIG. 1 is a side view, partially in section, of a certain presently preferred embodiment of a continuous ultraviolet curing system according to this invention.

In FIGS. 1 and 2, a resin-coated wire 1 moves vertically upward through curing chamber 2. Mounted in curing chamber 2 are a series of modules 3, each containing an ultraviolet lamp 4. There are an equal number of modules on each side of the wire and the number of modules exceeds the number necessary to cure the resin. The modules on one side alternate with the modules on the other side. Opposite each module is a reflector 5 which reflects light back onto wire 1 and behind each lamp 4 is a reflector 6 which reflects light onto wire 1. Each module can be easily removed by sliding it horizontally out of curing chamber 2. Each module is provided with an air duct 7 so that the lamps 4 can be cooled with forced air to prevent glass-to-metal seals from melting and to operate at a temperature closer to optimum. The air is removed through exhaust port 8.

A switch 9 is provided to control the flow of electricity to the modules. An ammeter 10 measures the current being drawn by any lamp designated by selector switch 11. The lamps are checked periodically. If they are drawing more than normal current, a substitute lamp on the same side is turned on, the module containing the defective lamp is removed, the defective lamp is replaced, and the module returned to curing chamber.

Referring now particularly to FIG. 2 for more details of the structure of module 3, an electrical connector 12 is provided so that putting the module in place in the curing chamber automatically makes an electrical connection to the lamp. A switch (not shown) is also provided on the outside of the modules so that the lamp can be turned on and off.

It should be apparent that the apparatus is suitable for use with any electromagnetic source of radiation, although ultraviolet lamps are preferred. A means of monitoring the condition of the lamps is preferably provided. This can be done with an ammeter which measures the current being drawn by the lamp as deteriorating lamps draw more current. Reflectors are preferably placed opposite and behind each lamp to increase their effectiveness. The reflector behind the lamp should be elliptical and the reflector opposite the lamp should be flat for greatest advantage. The reflector behind the lamp is especially useful when round wire is being cured. The lamps are preferably mounted perpendicular to the wire so that two to as many as thirty wires can be cured simultaneously in the apparatus. Each lamp is preferably about 100 to about 300 watts, about 6 to about 24 inches long, and is about 2 to about 10 inches from the wire. The distance between the lamp and the wire is important because at less than about 2 inches the heat may burn the insulation and at more than about 10 inches the light is much less intense. At least two excess lamps should be provided though normally the total number of lamps will not exceed twelve.

The wire may be of any geometrical shape in cross-section, although the apparatus is especially useful with flat wire. The resin on the wire may be any type of resin curable with electromagnetic radiation, such as epoxies, polyesters, polyenes, etc. Resins which are 100% solids and are curable with ultraviolet light, such as certain polyene resins, are preferred as they use less energy.

We claim:

1. An electromagnetic curing system for curing a resinous coating on an elongated member comprising (1) a curing chamber through which said elongated member passes;

(2) a plurality of modules alternately positioned in said curing chamber on opposite sides of said elongated member, each module containing a source of electromagnetic radiation directed at said elongated member, the number of said modules exceeding the number necessary to cure said resinous coating on said elongated member when all of said sources of electromagnetic radiation are on, each module being removable from said curing chamber from a side other than the side facing said elongated member, so that each module can be replaced during the operation of said electromagnetic curing system without stopping its operation;

(3) means for individually turning on and off each of said sources of electromagnetic radiation.

2. An electromagnetic curing system according to claim 1 including means for detachably electrically connecting each module to said curing chamber.

3. An electromagnetic curing system according to claim 1 including means for monitoring the condition of said sources of electromagnetic radiation to provide a warning of failure or impending failure.

4. An electromagnetic curing system according to claim 3 wherein said means for monitoring is an ammeter.

5. An electromagnetic curing system according to claim 1 including a reflector opposite each source of electromagnetic radiation which reflects said electromagnetic radiation onto said elongated member.

6. An electromagnetic curing system according to claim 5 including a reflector behind each source of electromagnetic radiation which reflects said electromagnetic radiation past said source of electromagnetic radiation onto said elongated member.

7. An electromagnetic curing system according to claim 6 wherein said reflector which is opposite said source is flat and said reflector which is behind said source is elliptical.

8. An electromagnetic curing system according to claim 1 wherein the number of said lamps is 4 to 12.

9. An electromagnetic curing system according to claim 1 including means for cooling each source of electromagnetic radiation.

10. An electromagnetic curing system according to claim 1 wherein said elongated member is a flat wire.

11. An electromagnetic curing system according to claim 1 wherein said flat wire is coated with a 100% solid UV curable polyene resin.

12. An electromagnetic curing system according to claim 1 wherein electromagnetic radiation can pass directly from said source of electromagnetic radiation to said elongated member.

13. An electromagnetic curing system according to claim 1 wherein said source of electromagnetic radiation is an ultraviolet lamp.

14. An electromagnetic curing system according to claim 1 wherein said ultraviolet lamp is perpendicular to said elongated member.

15. An electromagnetic curing system according to claim 1 wherein said elongated member moves vertically upward through said curing chamber.

16. An electromagnetic curing system according to claim 1 wherein said curing chamber can accommodate 2 to 30 elongated members simultaneously.

17. An electromagnetic curing system according to claim 1 wherein said source of electromagnetic radiation is about 2 to about 10 inches from said elongated member.

* * * * *